US006439953B1

(12) United States Patent
Liu

(10) Patent No.: US 6,439,953 B1
(45) Date of Patent: Aug. 27, 2002

(54) THREE-DIMENSIONAL BUILT-UP TOY WITH FREELY CONNECTABLE BASES

(76) Inventor: Kuo-Ching Liu, 5Fl., No. 11, Alley 1, Lane 1, Sec. 1, Yunhan S. Rd., Lujou City, Taipei (TW), 247

( * ) Notice: Subject to any disclaimer, the term of this patent is extended or adjusted under 35 U.S.C. 154(b) by 0 days.

(21) Appl. No.: 09/993,476

(22) Filed: Nov. 27, 2001

(51) Int. Cl.[7] ..... A63H 3/08; A63H 3/10

(52) U.S. Cl. ..... 446/387; 446/388; 446/385; 446/488; 434/259

(58) Field of Search ..... 446/97, 487, 480, 446/387, 85, 388, 385; 434/259, 258

(56) References Cited

U.S. PATENT DOCUMENTS 2,035,353 A * 3/1936 Torme ..... 446/316
2,097,267 A * 10/1937 Warren
2,145,610 A * 1/1939 Rundle ..... 446/388
2,314,744 A * 3/1943 Warren ..... 446/387
3,592,469 A * 7/1971 Glass et al. ..... 273/446
4,925,429 A * 5/1990 Kaulfuss et al. ..... 446/487
5,332,231 A * 7/1994 McIntosh ..... 273/450
5,593,337 A * 1/1997 Lapointe ..... 446/125

* cited by examiner

*Primary Examiner*—Jacob K. Ackun
*Assistant Examiner*—Bena B. Miller
(74) *Attorney, Agent, or Firm*—Rosenberg, Klein & Lee

(57) ABSTRACT

A three-dimensional built-up toy with freely connectable bases mainly includes at least one base in the form of a flat piece having a plurality of insertion slots formed thereon, and at least one figure and a plurality of matching decorations formed on and removable from the at least one base. The at least one figure and the plurality of matching decorations are integrally provided at lower ends with connecting sections adapted to insert into any of the insertion slots on the at least one base to hold the figure and the decorations to the at least one base in an upright position. The at least one base is provided along peripheral edges with coupling means. Two or more of the bases could be connected together to provide a large flat plane by engaging the coupling means on different bases with one another.

2 Claims, 3 Drawing Sheets

THREE-DIMENSIONAL BUILT-UP TOY WITH FREELY CONNECTABLE BASES

BACKGROUND OF THE INVENTION

1. Field of the Invention

The present invention relates to a three-dimensional built-up toy with freely connectable bases, each of which has coupling means provided along peripheral edges thereof to enable connection of multiple bases to one another at these coupling means to form a large flat plane for holding more figures and decorations thereto to create changeful three-dimensional toys.

2. Description of Prior Art

In a conventional three-dimensional built-up toy with changeable clothes invented by the same applicant of the present invention, there is included a doll in the form of a flat part being provided at one side near a middle portion thereof with a first slit of a predetermined depth, and at a lower end with a connecting edge; a coupling element in the form of a flat part being provided at one side with a second slit corresponding to the first slit on the doll, so that the coupling element is detachably assembled to the doll through engagement of the second slit on the coupling element with the first slit on the doll; a plurality of pieces of clothes in the form of flat parts being provided at one side with a third slit corresponding to the second slit on the coupling element, so that the clothes may be removably attached to the doll via the coupling element by engaging the third slit on the clothes with the second slit on the coupling element; and a base in the form of a flat part being provided at predetermined positions with a plurality of insertion slots, into which the connecting edge of the doll is inserted for the doll to stand upright on the base. The pieces of clothes may be selectively put onto the doll through the coupling element depending on a player's imagination, enabling the doll to change clothes at any time.

A drawback of the above-mentioned three-dimensional toy with changeable clothes is that it has only one base and the doll could be connected only to a restricted space on the one single base.

SUMMARY OF THE INVENTION

A primary object of the present invention is to provide a three-dimensional built-up toy with freely connectable bases. The toy mainly includes at least one base, and at least one figure and a plurality of matching decorations detachably formed on the at least one base by, for example, stamping contours on the base. The figure and the matching decorations are integrally provided at lower ends with downward projected connecting sections, and the at least one base is provided at predetermined positions with a plurality of insertion slots, into anyone of which the connecting sections of the figure and the matching decorations may be inserted. After the figure and the matching decorations are torn out of the at least one base along the stamped contours, they could be held to the base in a upright position by selectively inserting the connecting sections into the insertion slots. The at least one base with the figure and the matching decorations removed therefrom is reused instead of being discarded.

Another object of the present invention is to provide a three-dimensional built-up toy with freely connectable bases, each of which is provided along peripheral edges with coupling means, so that multiple bases could be connected together at the coupling means to create a large flat plane onto which more figures and matching decorations could be freely inserted.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
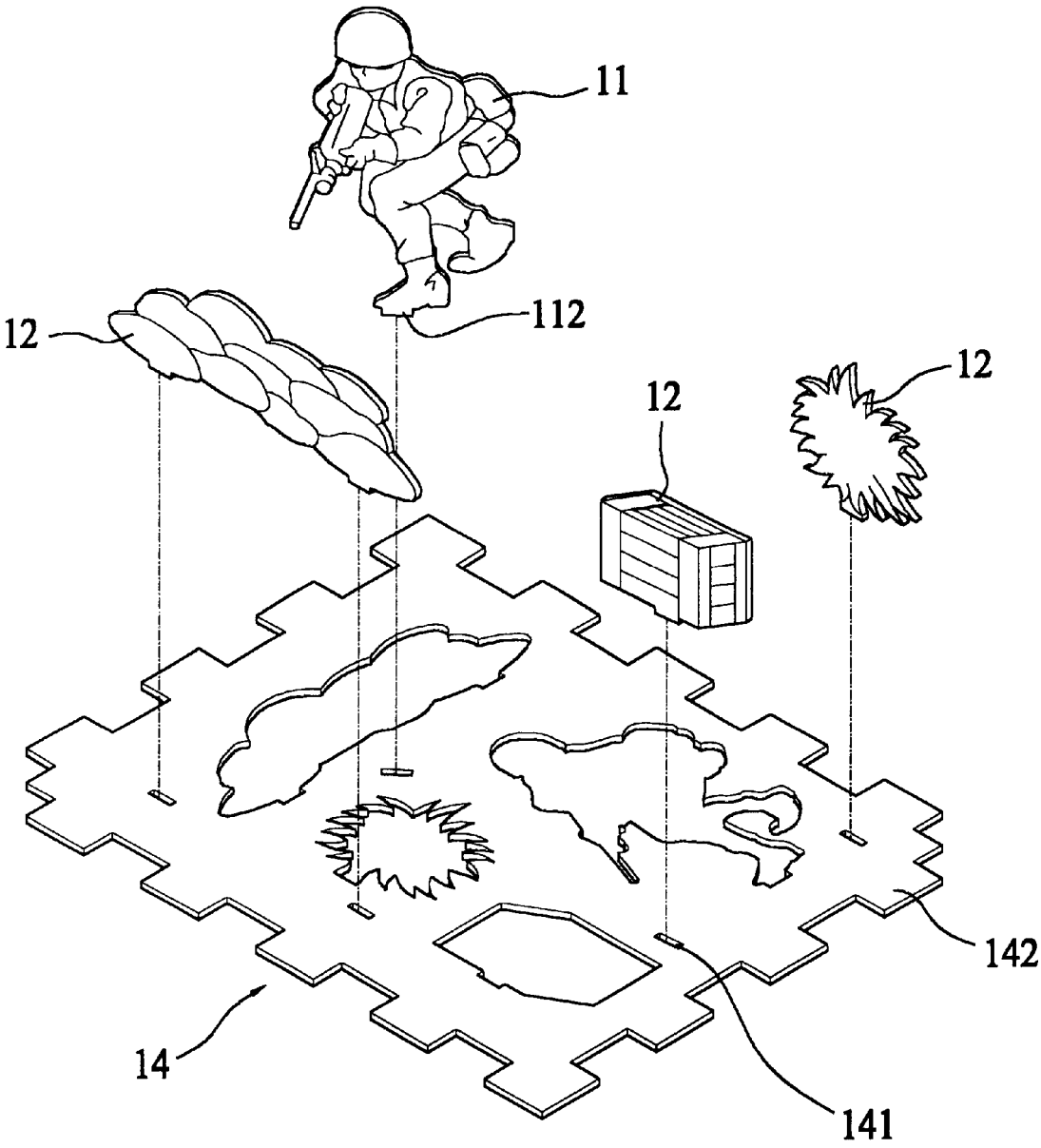
FIG. 1 is an exploded perspective view of a first embodiment of the present invention.
Figure 2:
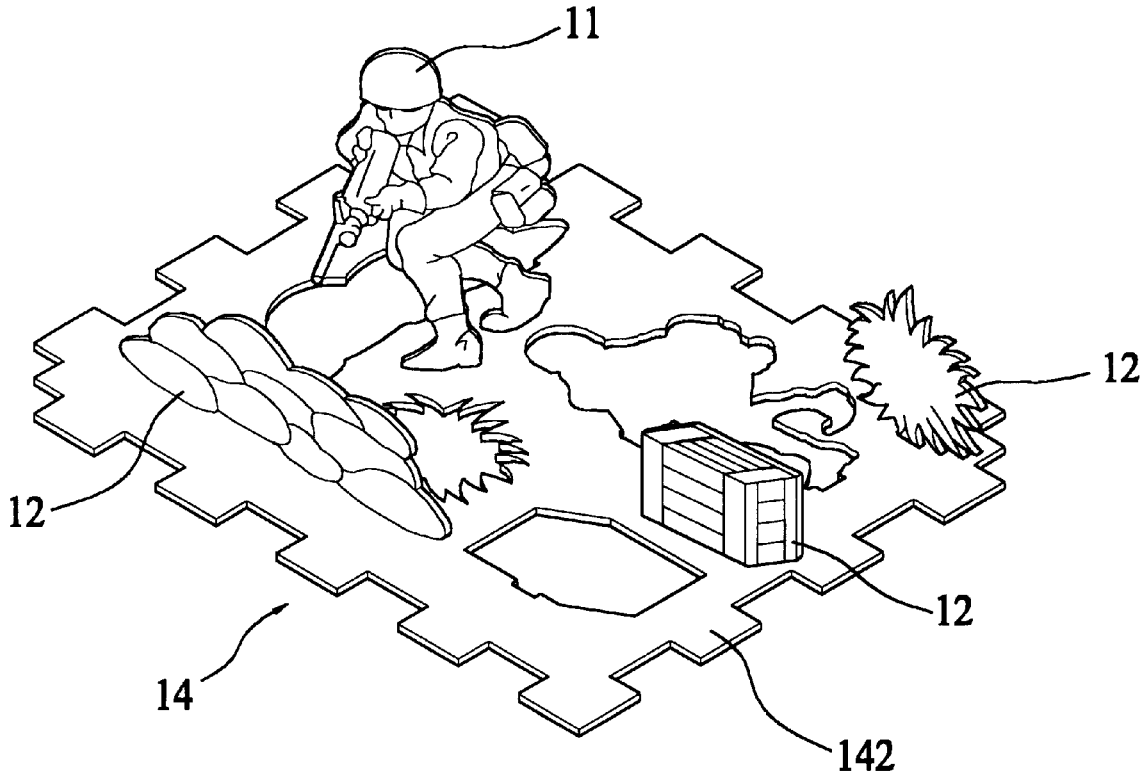
FIG. 2 is an assembled perspective view of FIG. 1.

Please refer to FIGS. 1 and 2 that are exploded and assembled perspective views, respectively, of a first embodiment of the present invention. As shown, the present invention relates to a three-dimensional built-up toy with freely connectable bases. The toy includes at least one base 14 in the form of a flat part, on which at least one FIG. 11, a plurality of matching decorations 12, and a plurality of insertion slots 141 are formed by, for example, stamping, so that the at least one FIG. 11 and the plurality of matching decorations 12 all are flat parts and could be easily torn out of the base 14. The FIG. 11 and the matching decorations 12 are integrally provided at their respective lower edges with at least one downward projected connecting section 112 that are adapted to insert into any one of the plurality of insertion slots 141 to hold the FIG. 11 and the matching decorations 12 to the base 14 in an upright position and therefore constitutes a three-dimensional built-up toy from flat parts. After the FIG. 11 and the matching decorations 12 are torn out of the base 14, the remained base 14 may be painted to show a pattern or a background matching with the FIG. 11 and the decorations 12 without being arbitrarily discarded to form an unnecessary waste and a pollution source to the environment.

Figure 3:
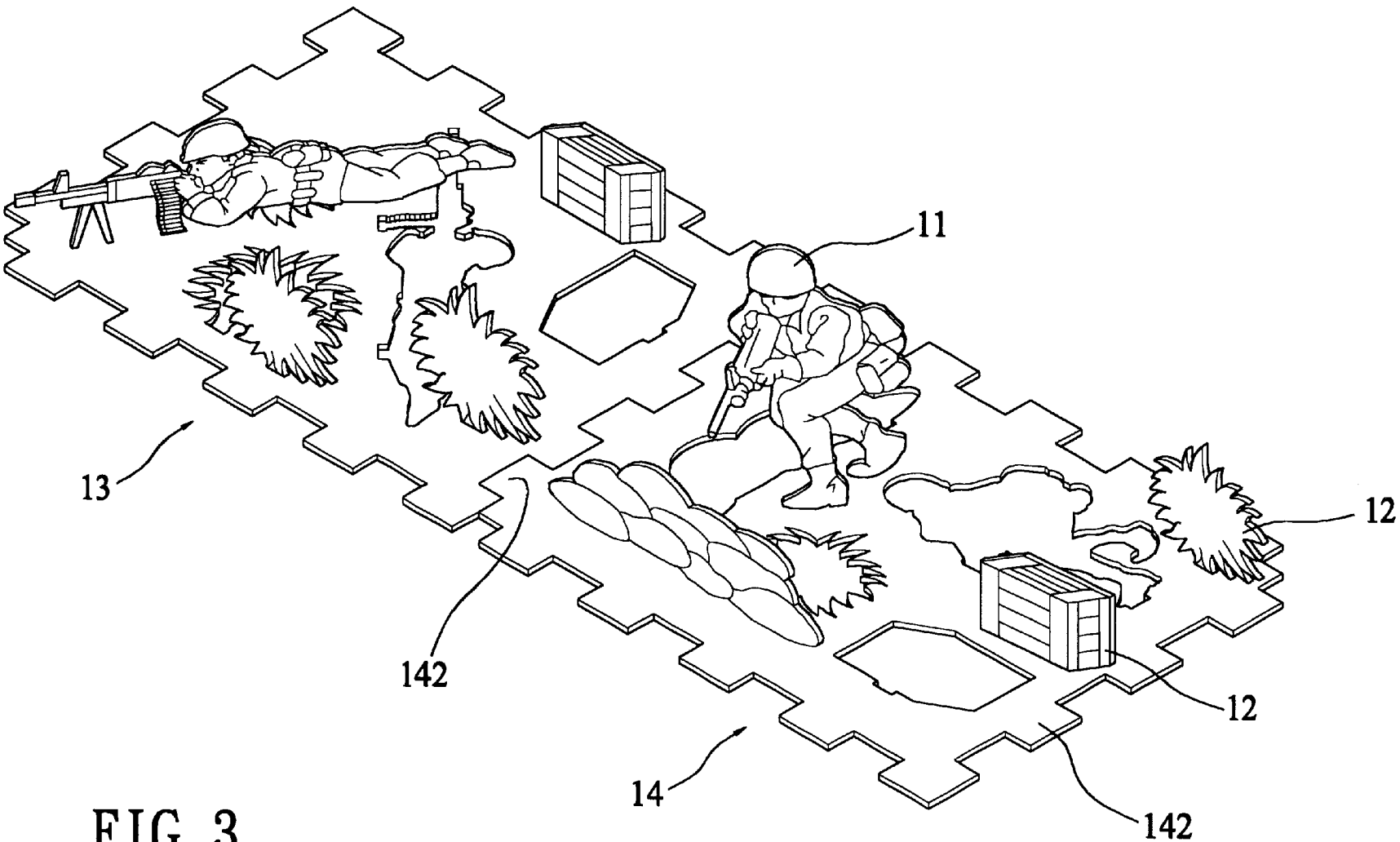
FIG. 3 is an assembled perspective view of a second embodiment of the present invention.

Please refer to FIG. 3 that shows another embodiment of the present invention. The flat base 14 is provided along peripheral edges with coupling means 142. In a preferred embodiment of the present invention illustrated in FIG. 3, the coupling means 142 are toothed edges including alternating tenons and mortises. Any two bases 14 may be connected together along their peripheral edges by engaging tenons on a first base 14 with mortises on a second base 14, so that a large flat plane could be formed from multiple pieces of mutually coupled bases 14. A user may employ his or her imagination to connect differently painted bases 14 in different ways to create a unique space for a desired three-dimensional built-up toy.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A three-dimensional built-up toy with freely connectable bases, comprising:

at least one base in the form of a flat piece having a plurality of insertion slots provided at predetermined positions; said at least one base being provided along peripheral edges with coupling means such that an engagement of said coupling means on a first one of said base with said coupling means on a second one of said base enables formation of a large flat plane;

at least one figure being formed on said at least one base in a predetermined manner, such that said at least one figure is in the form of a flat part and could be easily torn out of said at least one base, and said at least one figure being integrally provided at a lower end with a downward projected connecting section; and a plurality of decorations matching with said at least figure being formed on said at least one base in a predetermined manner, such that said matching decorations are in the form of flat parts and could be easily torn out of said at least one base, and said matching decorations being integrally provided at respective lower ends with a downward projected connecting section; and said connecting sections of said at least one figure and said plurality of matching decorations being adapted to insert into any of said plurality of insertion slots on said at least one base to uprightly hold said figure and said matching decorations to said at least one base at different locations depending on a user's different ideas.

2. The three-dimensional built-up toy with freely connectable bases as claimed in claim 1, wherein said coupling means provided on said at least one base are toothed edges including alternating tenons and mortises.

* * * * *